US011369185B2

(12) United States Patent
Bonnema et al.

(10) Patent No.: US 11,369,185 B2
(45) Date of Patent: Jun. 28, 2022

(54) MULTI-USE PACK STAY

(71) Applicant: JanSport Apparel Corp., Alameda, CA (US)

(72) Inventors: Ahren Bonnema, Alameda, CA (US); Howard Li, Alameda, CA (US); Jayson Yagi, Alameda, CA (US)

(73) Assignee: Jansport Apparel Corp., Alameda, CA (US)

( * ) Notice: Subject to any disclaimer, the term of this patent is extended or adjusted under 35 U.S.C. 154(b) by 14 days.

(21) Appl. No.: 16/502,286

(22) Filed: Jul. 3, 2019

(65) Prior Publication Data

US 2021/0000244 A1 Jan. 7, 2021

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01); *A45F 2003/045* (2013.01)

(58) Field of Classification Search
CPC . A45F 3/04; A45F 2003/045; A45F 2003/003
USPC ..... 224/259
See application file for complete search history.

(56) References Cited

U.S. PATENT DOCUMENTS 2,080,620 A * 5/1937 Raymond ..... B43L 13/206 D19/39
3,923,216 A * 12/1975 Fambach ..... A45F 3/08 224/636
4,074,839 A * 2/1978 Wood ..... A45F 3/08 224/635
4,479,595 A * 10/1984 Opsal ..... A45F 3/04 224/644
4,934,573 A * 6/1990 Jaeger ..... A45F 3/08 224/628
5,131,576 A * 7/1992 Turnipseed ..... A45F 3/08 224/907
5,236,112 A * 8/1993 Robinson ..... A45F 3/08 224/630
5,320,262 A * 6/1994 Levis ..... A45F 3/04 224/641
5,341,974 A * 8/1994 Robinson ..... A45F 3/047 224/901.2

(Continued)

*Primary Examiner* — Nathan J Newhouse
*Assistant Examiner* — Lester L Vanterpool
(74) *Attorney, Agent, or Firm* — Smith, Gambrell & Russell LLP

(57) ABSTRACT

Backpacks are described herein. An example backpack may comprise a main body. The main body may define a cavity for carrying a load. The example backpack may comprise one or more shoulder straps. The one or more shoulder straps may be coupled to the main body. The one or more shoulder straps may be configured to extend adjacent a first surface of the main body. The example backpack may comprise one or more multi-use stays. The one or more multi-use stays may be disposed adjacent the first surface of the main body. The one or more multi-use stays may comprise a generally curvilinear stay body configured to provide support to the main body. The stay body may comprise a first utility feature disposed adjacent at least one of a pair of longitudinal ends thereof. The stay body may comprise a second utility feature formed therein between the longitudinal ends.

10 Claims, 6 Drawing Sheets

(56) References Cited

U.S. PATENT DOCUMENTS 5,366,126 A * 11/1994 Dausien ..... A45F 3/04 224/630
5,553,759 A * 9/1996 McMaster ..... A45F 3/08 224/264
5,904,282 A * 5/1999 Gleason ..... A45F 3/08 224/636
5,984,157 A * 11/1999 Swetish ..... A45F 3/10 224/641
6,276,584 B1 * 8/2001 McLachlan ..... A45F 3/08 224/633
6,892,915 B2 * 5/2005 Mares ..... A45F 3/20 224/630
D507,697 S * 7/2005 Seong ..... D3/216
7,658,307 B2 * 2/2010 Skupin ..... A45F 5/004 224/675
7,726,530 B1 * 6/2010 Exposito ..... A45F 3/08 224/628
D630,011 S * 1/2011 Knight ..... D3/216
8,181,834 B1 * 5/2012 Howell ..... A45F 3/06 190/127
8,678,258 B1 * 3/2014 Knight ..... A45F 3/08 224/628
8,783,537 B2 * 7/2014 Ghassemi ..... A45F 3/04 224/628
9,119,459 B2 * 9/2015 Kim ..... A45F 3/08
D833,749 S * 11/2018 Meador, III ..... D3/318
10,231,534 B1 * 3/2019 Meador, III ..... A45F 3/10
10,463,137 B2 * 11/2019 Simione ..... A45F 3/08
2005/0035170 A1 * 2/2005 Sears ..... A45F 3/12 224/628
2006/0191969 A1 * 8/2006 Goulding ..... A45F 3/08 224/637
2008/0142562 A1 * 6/2008 Cheng ..... A45F 3/08 224/628
2011/0035946 A1 * 2/2011 Menceles ..... A47G 21/02 383/127
2013/0105537 A1 * 5/2013 Shalom ..... A45F 3/08 224/628
2015/0189974 A1 * 7/2015 Bercaw ..... A45F 3/04 224/633
2019/0022847 A1 * 1/2019 Weathers ..... B25B 13/04

* cited by examiner

MULTI-USE PACK STAY

BACKGROUND

Backpacks may be used by users traveling to isolated locations. The user of a backpack may carry it for long periods of time while traveling. This can be uncomfortable as a lot of pressure and strain are placed on the back and shoulders of the user. Moreover, items in a backpack may be the only items accessible to a user of a backpack in a remote location. Space within a backpack may be limited. Certain items may be predictably useful for users in isolated locations; however, the certain items may take up some of the limited space within the backpack.

Therefore, improvements in conventional backpacks are needed.

SUMMARY

Backpacks are described herein. An example backpack may comprise a main body. The main body may define a storage area for carrying a load. The example backpack may comprise one or more shoulder straps. The one or more shoulder straps may be coupled to the main body. The one or more shoulder straps may be configured to extend adjacent a first surface of the main body. The main body of the backpack may be curvilinear in shape in order to support the user's back. The example backpack may comprise one or more multi-use stays. The one or more multi-use stays may be disposed adjacent the first surface of the main body. The one or more multi-use stays may comprise a generally curvilinear stay body configured to provide additional support to the curvilinear main body. The stay body may comprise a first utility feature disposed adjacent at least one of a pair of longitudinal ends thereof. The stay body may comprise a second utility feature formed therein between the longitudinal ends.

Multi-use stays for a backpack are described herein. An example multi-use stay may comprise a stay body comprising a generally curvilinear shape. The example multi-use stay may comprise a first utility feature disposed adjacent at least one of a pair of longitudinal ends of the stay body. The example multi-use stay may comprise a second utility feature formed in the stay body between the longitudinal ends.

BRIEF DESCRIPTION OF THE DRAWINGS

The following drawings show generally, by way of example, but not by way of limitation, various examples discussed in the present disclosure. In the drawings.

DETAILED DESCRIPTION

Figure 1:
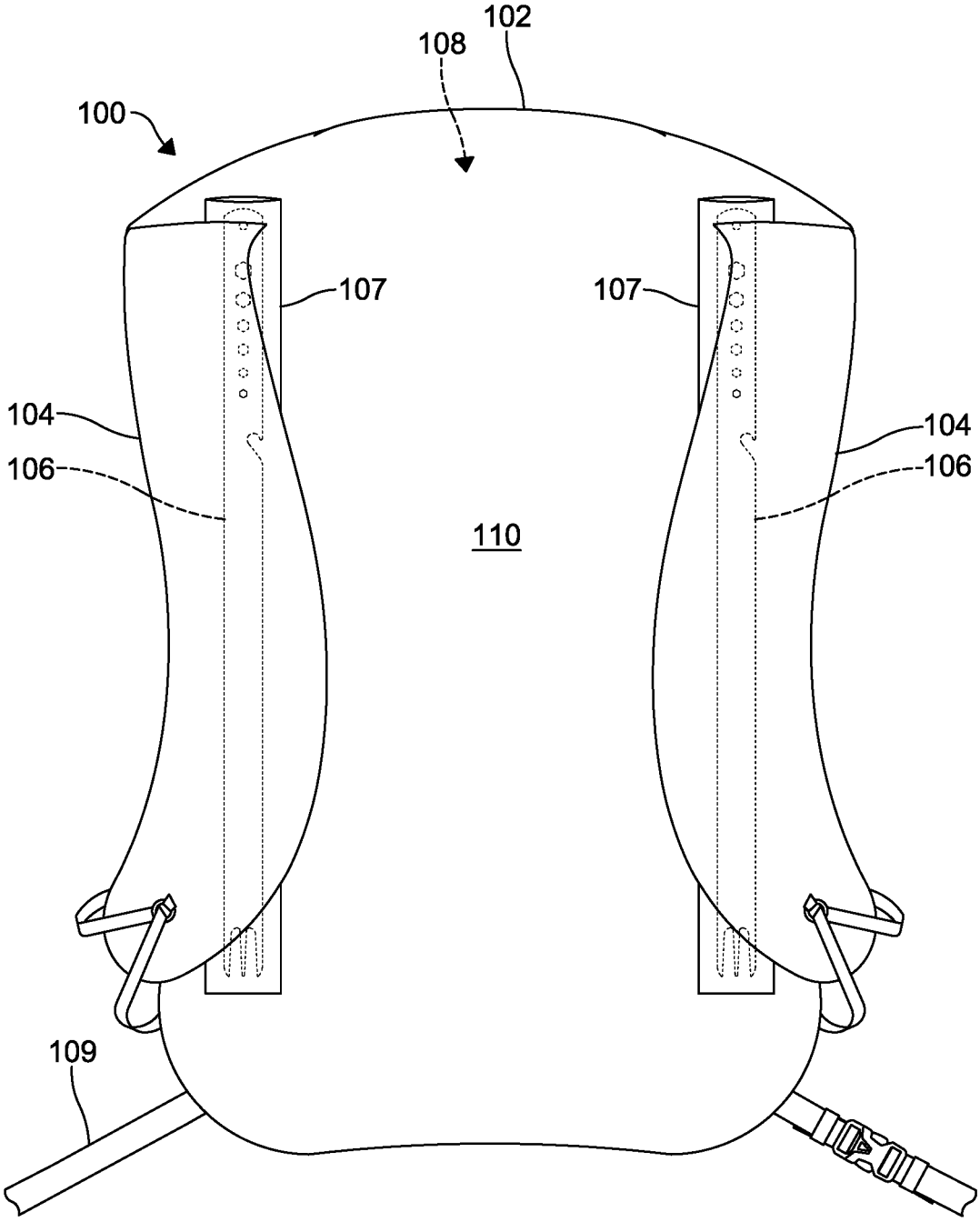
FIG. 1 is an elevation view of an example backpack in accordance with the present disclosure.

Packs such as backpacks may comprise support structures to support a load that is being carried in the pack. As an example, rigid support structures such as a stays may be incorporated in a pack to translate at least a portion of the load to certain areas of a body of the wearer.

A backpack may comprise one or more multi-use stays. The multi-use stays may be disposed in various configurations, such as in a vertical configuration. The one or more multi-use stays may be configured to generally align with a shape of a back of a user of the backpack. As an example, the multi-use stays may comprise an ergonomic shape or curvature to fit with a wearer's natural curvature of the back. Other configurations of multi-use stays may be used. The one or more multi-use stays may be secured to (e.g., inserted in, affixed to, etc.) the backpack to maintain the structure of the backpack and/or to provide support for the user by maintaining contact between a user and a backpack (e.g., to reduce bumping of the backpack into the user, and/or provide reinforcement for the backpack, etc.) when the backpack is in use. As an example, the backpack may comprise one or more sleeves for receiving the one or more multi-use stays when not in use. The sleeves may be formed from the same of different material as the backpack. The sleeves may define a pouch that allows the multi-use stays to be selective removed from the enclosure of the sleeves.

The one or more multi-use stays may be removed from (e.g., detached from, etc.) the backpack. Each of the one or more multi-use stays may comprise a first longitudinal end, a second longitudinal end, and an area between the first longitudinal end and the second longitudinal end. The first longitudinal end of the one or more multi-use stays comprise a utility feature. For example, the first longitudinal end of the one or more multi-use stays may be configured as a fork or a spoon, or other tool or utensil. Additionally or alternatively, the second longitudinal end may comprise a utility feature. The area between the first longitudinal end and the second longitudinal end of the one or more multi-use stays may comprise one or more utility features. For example, the area between the first longitudinal end and the second longitudinal end of the one or more multi-use stays may comprise a bottle opener, a measuring implement, wrench apertures, and the like. Any number of utility features may be disposed on or formed in the multi-use stays. The multi-use stays may be used in various temperature conditions and may withstand changes in hot and cold. As such, the one or more multi-use stays may be used over an open campfire, then cooled, and replaced back into the sleeve of the backpack. The multi-use stays may be used to loosen or tighten lugs or spikes in footwear. The utility features of the multi-use stays may be configured for certain activities and may be associated with expected activities for a certain type of backpack or line of backpacks. As an example, a lighter hiking pack may include multi-use stays with recreational utility features such as a bottle openers and fork tines. As a further example, a climbing pack may include multi-use stays configured with wrench apertures, picks, screw driver formations, and the like. However, any pack may include any utility feature and is not limited to a particular expected activity.

As illustrated, for example, in FIGS. 1-5, a backpack 100 may comprise a main body 102. The main body 102 may define a storage area 108 (e.g., enclosed cavity) for carrying a load. The backpack may comprise one or more shoulder straps 104. The one or more shoulder straps 104 may be coupled to the main body 102. The one or more shoulder straps 104 may be configured to extend adjacent a first surface 110 of the main body. The main body 102 may comprise a generally pliable body defining a volume for the containment of articles, the body generally having a height, width, and depth. Additionally or alternatively, at least one hip belt 109 may be coupled to the main body 102 and may be selectively fastened around a body of wearer when the backpack 100 is in use.

The backpack 100 may comprise one or more multi-use stays 106. The one or more multi-use stays 106 may be disposed adjacent the first surface of the main body.

As illustrated in FIG. 1, for example, a plurality of sleeves 107 may be disposed on or adjacent the main body 102 and may be configured to receive one or more multi-use stays 106. Each of the sleeves 107 may be spaced apart from each other. However, other configurations may be used.

Figure 2:
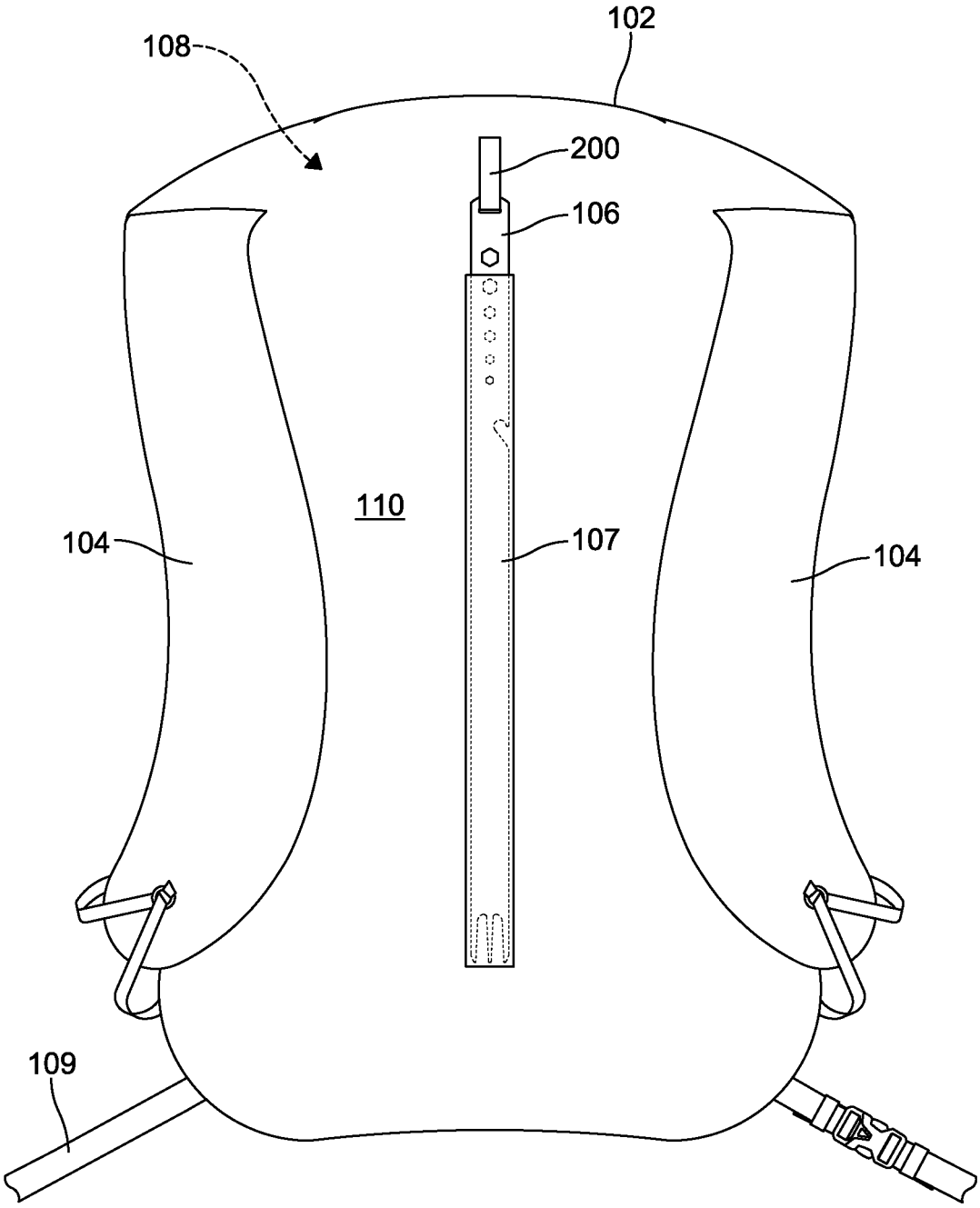
FIG. 2 is an elevation view of an example backpack in accordance with the present disclosure.

As illustrated in FIG. 2, for example, a single sleeve 107 may be disposed near a center of the main body 102. Other configurations may be used. The sleeve 107 may be open ended. The multi-use stay 106 may be removeably disposed in the sleeve 107. A tab 200 may be coupled to the stay 106 to allow a user to remove the stay 106 from the sleeve 107.

Figure 3:
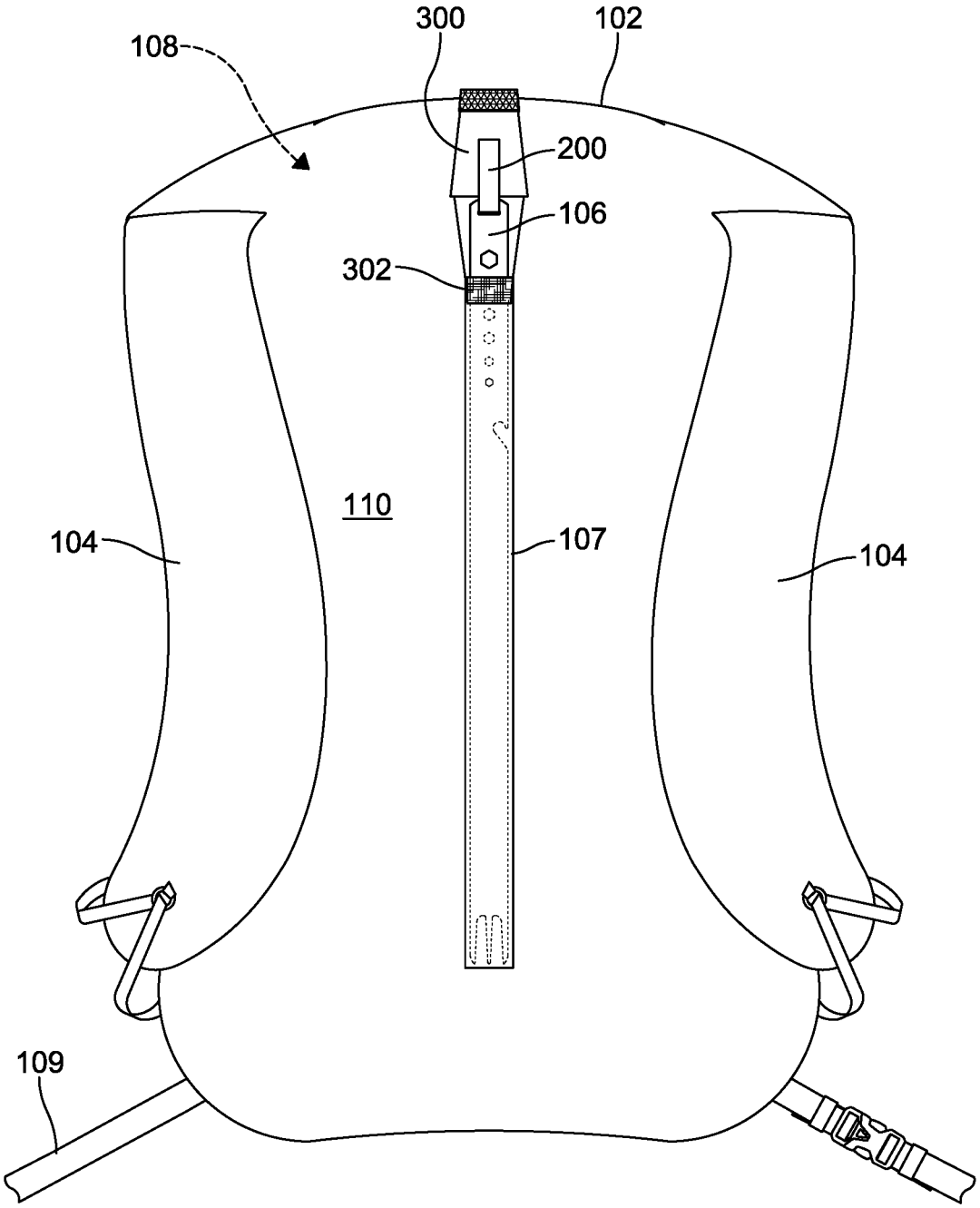
FIG. 3 is an elevation view of an example backpack in accordance with the present disclosure.

As illustrated in FIG. 3, for example, a single sleeve 107 may be disposed near a center of the main body 102. Other configurations may be used. The sleeve 107 may be open ended. The multi-use stay 106 may be removeably disposed in the sleeve 107. A tab 200 may be coupled to the stay 106 to allow a user to remove the stay 106 from the sleeve 107. A flap 300 may be coupled to one or more of the main body 102, the stay 106, or the sleeve 107. The flap 300 may be formed from a material configured to secure the stay 106 in the sleeve 107. As a further example, the flap 300 may be releaseably coupled to an attachment point 302 such as a snap, button, hook and loop fastener, or other fastener.

Figure 4:
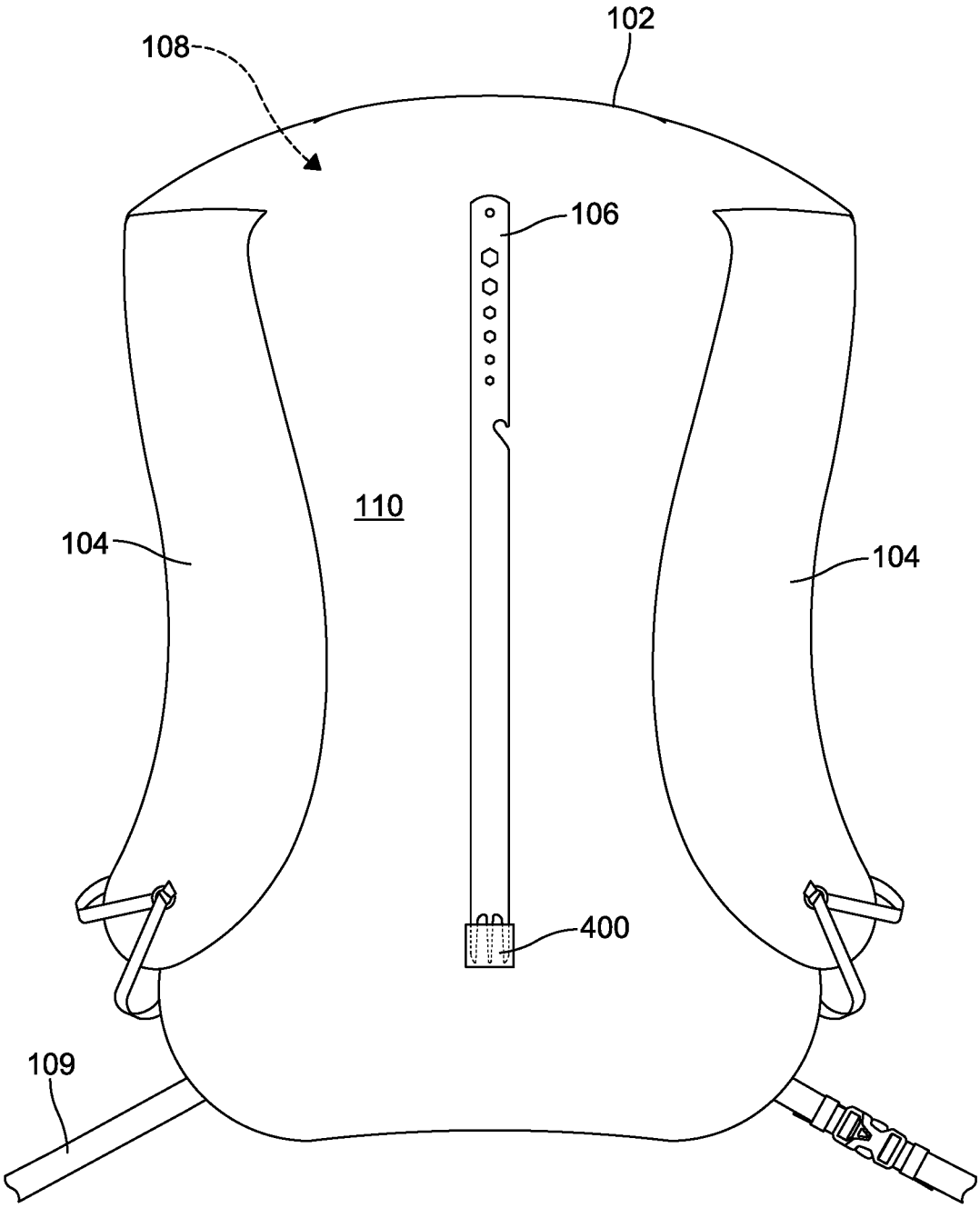
FIG. 4 is an elevation view of an example backpack in accordance with the present disclosure.
Figure 5:
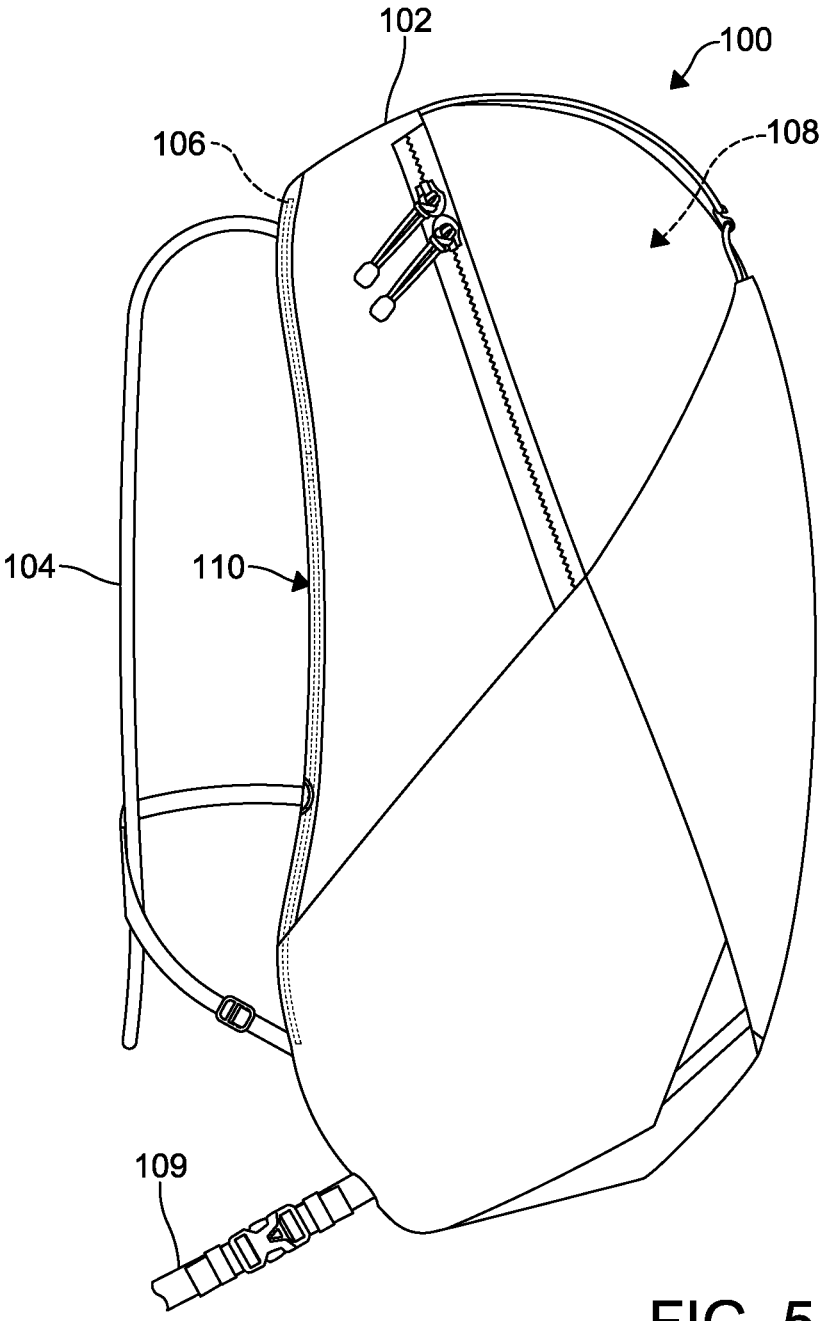
FIG. 5 is a side view of the example backpack of FIG. 1.

As illustrated in FIG. 4, for example, a cap 400 may be disposed near a center of the main body 102. Other configurations may be used. The cap 400 may be open ended. The multi-use stay 106 may be removeably disposed in the cap 400 to secure the stay 106 to the main body 102.

Figure 6:
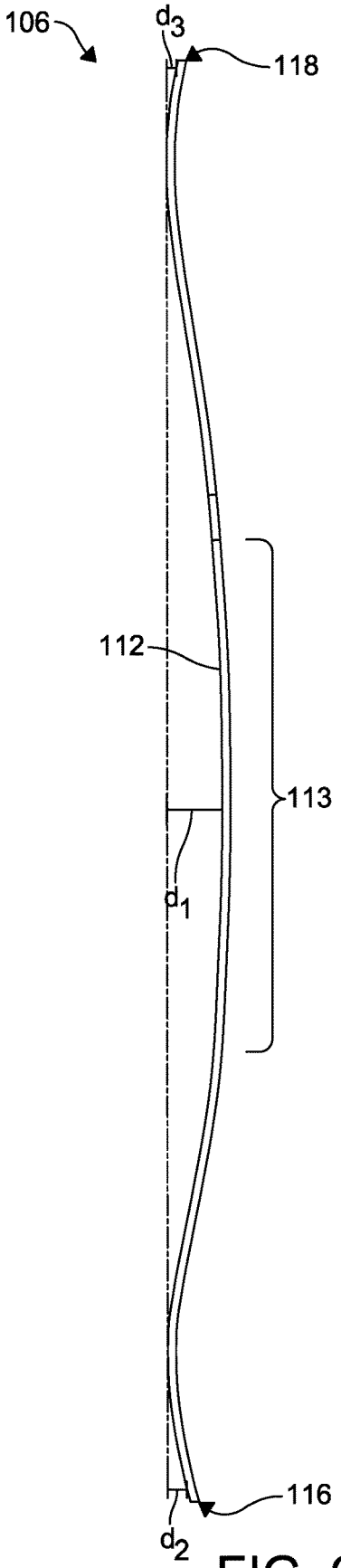
FIG. 6 is a side view of an example multi-use pack stay in accordance with the present disclosure.
Figure 7:
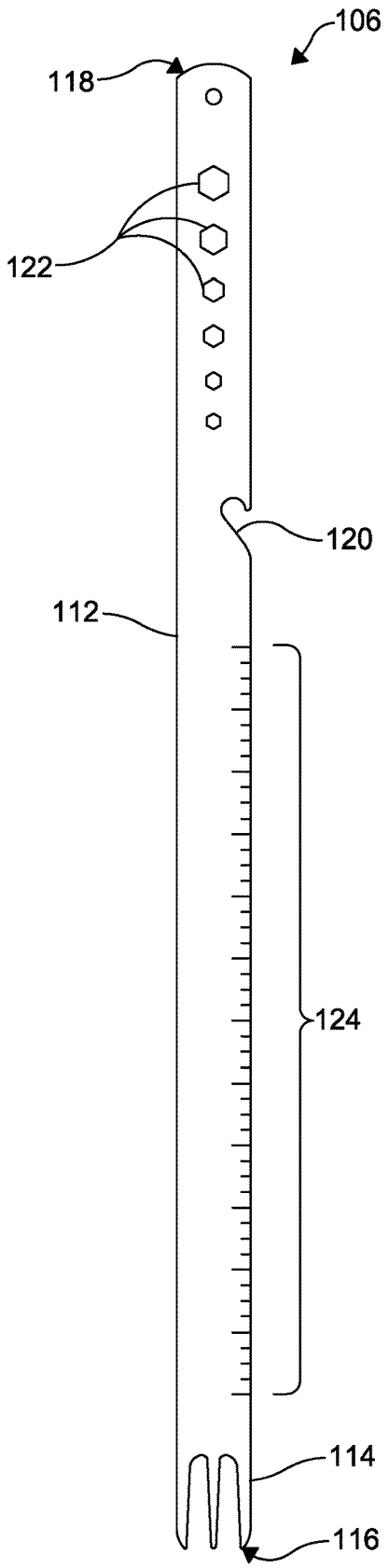
FIG. 7 is a front view of the multi-use pack stay of FIG. 6.

As more clearly shown in FIGS. 6-7, the one or more multi-use stays 106 may comprise a generally curvilinear stay body 112 configured to provide support and reinforcement when coupled to the main body 102 of the backpack 100. A center portion of the stay body 112 may define a generally arch shape that has a rise ($d_1$) from a horizontal axis. One or both of the longitudinal ends 116, 118 of the stay body 112 may have a rise ($d_2$, $d_3$) from a horizontal axis. The rise ($d_3$) of the center portion 113 may be greater than a rise ($d_2$, $d_3$) of the one or both of the longitudinal ends 116, 118. The stay body 112 may comprise metal. The stay body 112 may comprise aluminum. However, other materials may be used. The main body 102 may comprise at least one sleeve 107 configured to removeably receive the at least one multi-use stay 106. At least one sleeve 107 may be coupled to the main body 102. At least one sleeve 107 may be formed from the same or different material as the main body 102. The stay body 112 may comprise a first utility feature 114 disposed adjacent at least one of a pair of longitudinal ends 116, 118 thereof. The first utility feature 114 may comprise a plurality of fork tines. The first utility feature 114 may comprise a spoon. The first utility feature 114 may comprise a sharp edge. The first utility feature 114 may comprise a jagged surface for creating friction to ignite a fire. The first utility feature 114 may comprise a compass. The first utility feature 114 may comprise a level. Other utility features may be disposed adjacent least one of a pair of longitudinal ends 116, 118.

The stay body 112 may comprise a second utility feature 120 formed therein between the longitudinal ends 116, 118. The second utility feature 120 may comprise a bottle opener. The second utility feature 120 may comprise a hex aperture (e.g., wrench aperture, nut driver, etc.). The second utility feature 120 may comprise a plurality of hex apertures configured to fit a plurality of different sized hex nuts. The second utility feature 120 may comprise a sharp edge. The second utility feature 120 may comprise a ruler. The second utility feature 120 may comprise a jagged surface for creating friction to ignite a fire. Alternatively or additionally, other utility features 122, 124 may be disposed on or formed in the stay body 112.

In use, a wearer may hike to a remote location with a backpack such as backpack 100. The backpack may comprise at least one multi-use stay. The at least one multi-use stay may comprise a bottle opener. The at least one multi-use stay may comprise a spoon. The backpack may comprise a storage area for carrying various loads. A storage area of the backpack may comprise a bottle with a cap. A storage area of the backpack may comprise a packet of yogurt. The wearer may remove the bottle and/or the packet of yogurt from the backpack. The wearer may remove the at least one multi-use stay from the backpack. The wearer may use the bottle opener of the at least one multi-use stay to remove the cap from the bottle. The wearer may use the spoon of the at least one multi-use stay to eat the yogurt. Then, the wearer may replace the stays into the backpack (e.g., via sleeves) to provide ergonomic support when carrying the backpack.

As a further example, at least one multi-use stay may comprise a sharp edge. A storage area of the backpack may comprise a rope. The wearer may remove the rope from the backpack. The wearer may remove the at least one multi-use stay from the backpack. The wearer may use the measurements of the ruler of the at least one multi-use stay to measure a portion of the rope. The wearer may use the sharp edge of the at least one multi-use stay to cut the measured portion of the rope. Then, the wearer may replace the stays into the backpack (e.g., via sleeves) to provide ergonomic support when carrying the backpack.

The curvilinear shape of the multi-use stays may provide ergonomic support and comfortable fit as part of the backpack. However, the curvilinear shape of the multi-use stays may provide leverage for use outside of the backpack, such as a wrench, where the wrench aperture are disposed at or adjacent a curved area of the stay to allow angled access to a nut.

What is claimed is:

1. A backpack comprising:

a main body defining a storage area for carrying a load;

one or more shoulder straps coupled to the main body and extending adjacent a first surface of the main body;

one or more multi-use stays removeably disposed adjacent the first surface of the main body, wherein the one or more multi-use stays comprise an elongate curvilinear stay body provides support to the main body;

wherein the stay body comprises a first utility feature disposed adjacent at a first longitudinal end of the stay body, the first utility feature is configured to provide a first utility function when used outside of the backpack;

wherein the stay body comprises a second utility feature disposed at a maximum point of curvature adjacent a second longitudinal end of the stay body, the second longitudinal end opposite the first longitudinal end, wherein the second utility feature is different from the first utility feature and is configured to provide a second utility function when used outside of the backpack;

wherein each of the first and second longitudinal ends of the stay body and a center portion of the stay body has a rise from a horizontal axis, wherein the rise of the center portion is greater than a rise of each of the longitudinal ends;

wherein a location of the first utility feature and the second utility feature on the stay body provides leverage for use of at least one of the first utility feature or the second utility feature outside of the backpack; and wherein the first utility feature comprises a tool or utensil further comprising one or more of a plurality of fork tines, a spoon, a compass, or a level.

2. The backpack of claim 1, wherein the main body comprises a pliable body defining a volume for the containment of articles, the body having a height, width, and depth.

3. The backpack of claim 1, further comprising at least one hip belt coupled to the main body.

4. The backpack of claim 1, wherein the second utility feature comprises one or more of a bottle opener, a hex aperture, a plurality of hex apertures configured to fit a plurality of different sized hex nuts, a ruler, a compass, or a level.

5. The backpack of claim 1, wherein the stay body comprises aluminum.

6. The backpack of claim 1, wherein the main body further comprises at least one sleeve configured to removeably receive and enclose the at least one multi-use stay.

7. The backpack of claim 1, further comprising at least one sleeve coupled to the main body, the sleeve configured to removeably receive and enclose the at least one multi-use stay.

8. A multi-use stay for a backpack, the multi-use stay comprising:

a stay body comprising a curvilinear shape;

a first utility feature disposed adjacent a first end of a pair of longitudinal ends of the stay body, the first utility feature is configured to provide a first utility function when used outside of the backpack, wherein the first utility feature comprises a tool or utensil further comprising one or more of a plurality of fork tines, a spoon, a compass, or a level; and a second utility feature disposed at a maximum point of curvature adjacent a second end of the stay body, the second end opposite the first end, wherein the second utility feature is different from the first utility feature and is configured to provide a second utility function when used outside of the backpack, wherein each of the first and second ends of the stay body and a center portion of the stay body has a rise from a horizontal axis, wherein the rise of the center portion is greater than a rise of each of the first and second ends; and wherein the curvilinear shape of the stay body provides leverage for use of at least one of the first utility feature or the second utility feature outside of the backpack.

9. The multi-use stay of claim 8, wherein the second utility feature comprises one or more of a bottle opener, a hex aperture, a plurality of hex apertures configured to fit a plurality of different sized hex nuts, a ruler, a compass, or a level.

10. The multi-use stay of claim 8, wherein the stay body comprises aluminum.

* * * * *